US009441442B2

(12) United States Patent
Le et al.

(10) Patent No.: US 9,441,442 B2
(45) **Date of Patent: *Sep. 13, 2016**

(54) PORTABLE RAM BLOCK CHANGER

(71) Applicant: National Oilwell Varco, L.P., Houston, TX (US)

(72) Inventors: Tan Le, Houston, TX (US); Son Nguyen, Houston, TX (US); Dung Tran, Houston, TX (US); Scott Lee, Houston, TX (US)

(73) Assignee: National Oilwell Varco, L.P., Houston, TX (US)

( * ) Notice: Subject to any disclaimer, the term of this patent is extended or adjusted under 35 U.S.C. 154(b) by 129 days.

This patent is subject to a terminal disclaimer.

(21) Appl. No.: 14/243,460

(22) Filed: Apr. 2, 2014

(65) Prior Publication Data

US 2014/0209320 A1 Jul. 31, 2014

Related U.S. Application Data

(63) Continuation of application No. 12/848,547, filed on Aug. 2, 2010, now Pat. No. 8,720,476.

(60) Provisional application No. 61/231,561, filed on Aug. 5, 2009.

(51) Int. Cl.
*E21B 33/06* (2006.01)

(52) U.S. Cl.
CPC ..... *E21B 33/061* (2013.01); *E21B 33/062* (2013.01); *Y10T 137/6109* (2015.04)

(58) Field of Classification Search
CPC ..... E21B 33/061; E21B 33/062
See application file for complete search history.

(56) References Cited

U.S. PATENT DOCUMENTS

| | | | | |
|---|---|---|---|---|
| 3,658,287 | A * | 4/1972 | Lerouax | 251/1.3 |
| 3,910,535 | A * | 10/1975 | Ohnaka | 248/664 |
| 4,253,638 | A * | 3/1981 | Troxell, Jr. | 251/1.3 |
| 5,975,484 | A * | 11/1999 | Brugman et al. | 251/1.3 |
| 2006/0000992 | A1* | 1/2006 | Springett et al. | 251/1.3 |
| 2008/0142746 | A1* | 6/2008 | Hemphill et al. | 251/1.3 |
| 2011/0048736 | A1* | 3/2011 | Childers et al. | 166/379 |

* cited by examiner

*Primary Examiner* — R. K. Arundale
(74) *Attorney, Agent, or Firm* — Conley Rose, P.C.

(57) ABSTRACT

An apparatus for engaging and moving a ram block. In some embodiments, the apparatus, or ram block changer, includes a support bracket coupled to a blowout preventer and an articulated arm releasably coupled to the ram block. The ram block changer may further include a pivot coupling assembly having a first axis of rotation. The pivot coupling assembly extends through the support bracket and the articulated arm, wherein the articulated arm is rotatable about the first axis of rotation relative to the support bracket. The articulated arm may include a first member receiving the pivot coupling assembly therethrough, a second member coupled to the ram block, and a second pivot coupling assembly having a second axis of rotation spaced apart from the first axis of rotation and extending through the first and second members. The second member is rotatable about the second axis of rotation relative to the first member.

24 Claims, 16 Drawing Sheets

PORTABLE RAM BLOCK CHANGER

CROSS-REFERENCE TO RELATED APPLICATIONS

This application is a continuation of U.S. application Ser. No. 12/848,547 filed Aug. 2, 2010, and entitled "Portable Ram Block Changer," which claims the benefit of U.S. provisional application Ser. No. 61/231,561 filed Aug. 5, 2009 and entitled "Portable Ram Block Changer."

BACKGROUND

During the drilling and production of oil and gas wells, it may be necessary to manage high pressure fluids in the well. The subject matter disclosed herein relates to methods and apparatus for controlling pressure within a wellbore. In particular, embodiments disclosed herein include methods and apparatus for operating ram-type blowout preventers and the equipment associated with installation and maintenance of the ram block.

Blowout preventers are used in hydrocarbon drilling and production operations as a safety device that closes, isolates, and seals the wellbore. Blowout preventers are essentially large valves that are connected to the wellhead and comprise closure members capable of sealing and closing the well in order to prevent the release of high-pressure gas or liquids from the well. One type of blowout preventer used extensively in both low and high-pressure applications is a ram-type blowout preventer. A ram-type blowout preventer uses two opposed closure members, or rams, disposed within a specially designed housing, or body. The blowout preventer body has a bore that is aligned with the wellbore. Opposed cavities intersect the bore and support the rams as they move into and out of the bore. A bonnet is connected to the body on the outer end of each cavity and supports an operator system that provides the force required to move the rams into and out of the bore.

The rams are equipped with sealing members that engage to prohibit flow through the bore when the rams are closed. The rams may be pipe rams, which are configured to close and seal an annulus around a pipe that is disposed within the bore, or may be blind rams or shearing blind rams, which are configured to close and seal the entire bore. A particular drilling application may require a variety of pipe rams and blind rams. Therefore, in many applications multiple blowout preventers are assembled into blowout preventer stacks that comprise a plurality of ram-type blowout preventers, each equipped with a specific type of ram.

Ram-type blowout preventers are often configured to be operated using pressurized hydraulic fluid to control the position of the closure members relative to the bore. Although most blowout preventers are coupled to a fluid pump or some other active source of pressurized hydraulic fluid, many applications require a certain volume of pressurized hydraulic fluid to be stored and immediately available to operate the blowout preventer in the case of emergency.

Thus, the embodiments disclosed herein are directed to ram-type blowout preventers that seek to overcome limitations of the prior art in handling removeable ram blocks.

SUMMARY

An apparatus for engaging and moving a ram block is disclosed. In some embodiments, the apparatus, or ram block changer, includes a support bracket coupled to a blowout preventer and an articulated arm releasably coupled to a removeable ram block.

In some embodiments, the ram block changer includes a support portion disposed adjacent a blowout preventer and an articulated arm rotatably coupled to the support portion. The articulated arm includes a first member pivotally coupled to the support portion at a first axis of rotation and a second member pivotally coupled to the first member at a second axis of rotation. The second member is configured to couple to and support the ram block In some embodiments, the apparatus includes a support means coupled to a blowout preventer and an articulating means pivotably coupled to the support means at a first axis of rotation and supporting the ram block.

Thus, embodiments described herein comprise a combination of features and characteristics intended to address various shortcomings associated with conventional ram-type blowout preventers. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of exemplary embodiments of the invention, reference will now be made to the accompanying drawings in which.

DETAILED DESCRIPTION

Figure 1:
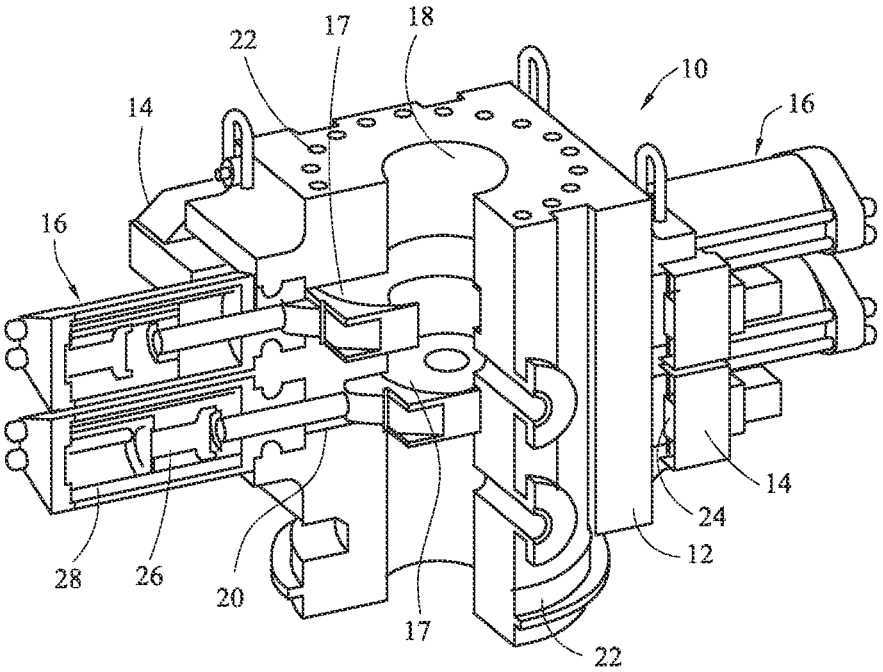
FIG. 1 is a perspective, partial cutaway view of a ram-type blowout preventer.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. Reference to up or down will be made for purposes of description with "up", "upper", "upwardly" or "upstream" meaning toward the surface of the well and with "down", "lower", "downwardly" or "downstream" meaning toward the terminal end of the well, regardless of the well bore orientation. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Figure 2:
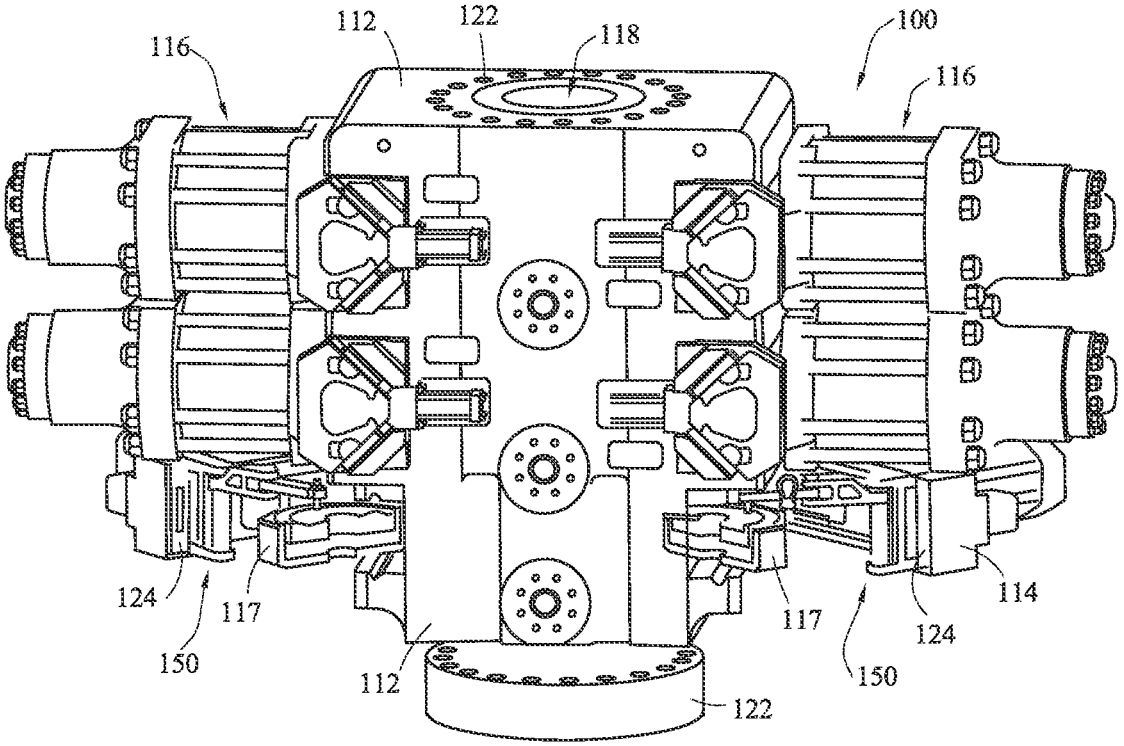
FIG. 2 is a perspective view of another ram-type blowout preventer, including a ram changer in accordance with principles taught herein.

Referring initially to FIG. 1, an exemplary ram-type blowout preventer (BOP) 10 is shown. In exemplary embodiments, the BOP 10 is an NXT® model BOP offered by National Oilwell Varco, L. P. Other BOP's are also fully contemplated. The BOP 10 includes a body 12, bonnets or doors 14, operator systems 16, and closure members or ram blocks 17. The body 12 includes a bore 18, opposed cavities 20, and upper and lower bolted connections 22 for assembling additional components above and below the BOP 10, such as in a blowout preventer stack assembly. The doors 14 are coupled to the body 12 by connectors 24 and hinges that allow the doors 14 to swing open to provide access to the ram blocks 17, as shown more fully in FIG. 2. The operator systems 16 are mounted to the doors 14 and use hydraulic piston 26 and cylinder 28 arrangements to move the ram blocks 17 through the cavities 20, into and out of the bore 18. While BOP 10 includes a double stacked ram block operation assembly, other arrangements are contemplated including a single assembly or a triple assembly as shown in FIG. 2.

In some circumstances installation of the ram block, or removal for maintenance or replacement, is required. Handling the ram block is labor intensive and presents safety risks because of its position in the BOP and its weight (e.g., 500 pounds). Referring now to FIG. 2, a BOP 100 comprises components similar to BOP 10, including a body 112, bonnets or doors 114, operator systems 116, ram blocks 117, a bore 118, upper and lower bolted connections 122, and connectors 124. Hinges couple the doors 114 to the body 112, and allow the doors 114 to swing open as shown for the bottom ram block operation assemblies. The ram blocks 117 can now be accessed for installation or removal. However, as noted, handling the ram blocks 117 is difficult. A ram block changer assembly 150 is coupled to the BOP 100 or disposed adjacent the BOP 100 for handling the ram blocks 117.

Figure 3:
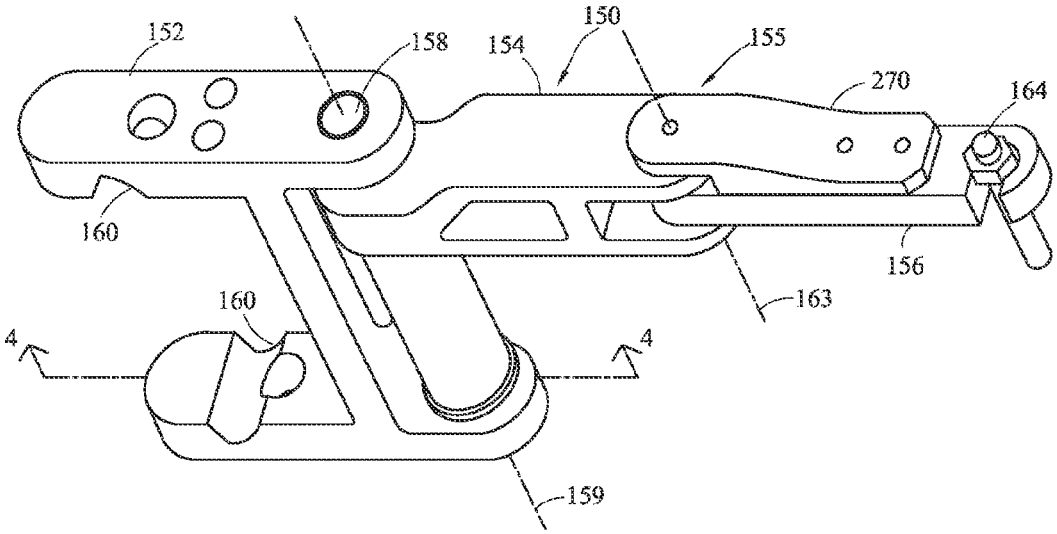
FIG. 3 is a perspective view of the ram changer assembly of FIG. 2, including an articulated arm.
Figure 4:
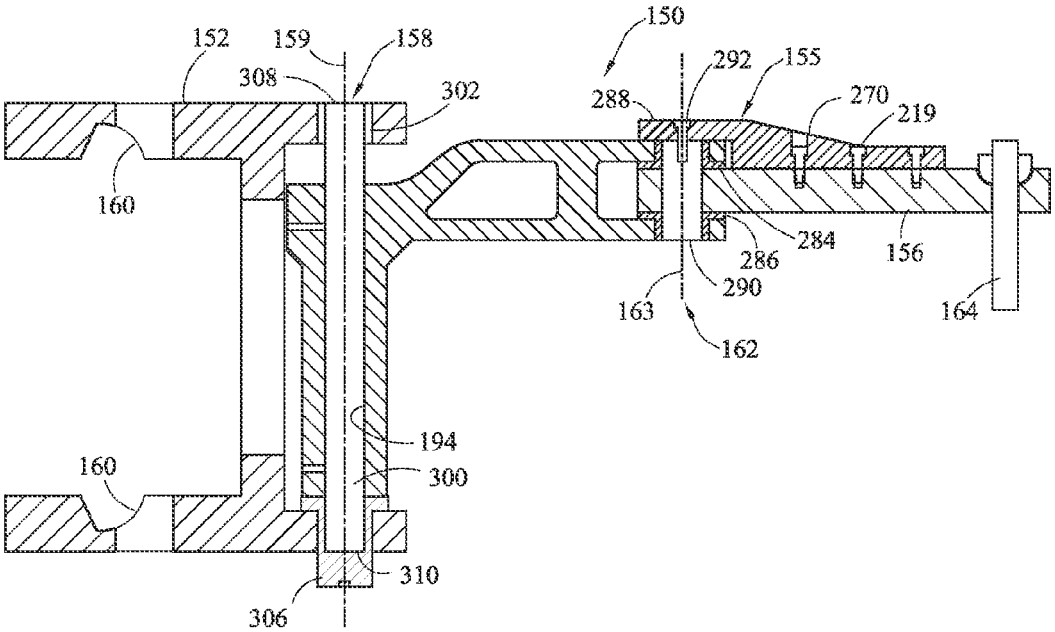
FIG. 4 is a cross-sectional view of the ram changer assembly of FIG. 3.

Referring now to FIGS. 3 and 4, the ram changer assembly 150 includes a support bracket 152 and an articulated arm 155, including an L-shaped intermediate member 154, a ram coupling member 156, and a stabilizer 270. The bracket 152 includes gripping grooves 160 for mounting the ram changer 150 onto the BOP 100 as explained more fully below. A coupling pivot assembly 158 rotatably couples the L-shaped intermediate member 154 to the bracket 152. Another coupling pivot assembly 162, visible in FIG. 4, rotatably couples the L-shaped intermediate member 154 to the ram coupling member 156 to form the articulation of the arm 155. In some embodiments, at least one of the coupling pivot assemblies 158, 162 is a bolt. The ram coupling member 156 may receive a bolt assembly 164 for coupling to the ram block. The coupling pivot assembly, or rotatable pivot point, 158 includes a first axis of rotation 159, and the coupling pivot assembly, or rotatable pivot point, 162 includes a second axis of rotation 163.

Figure 5:
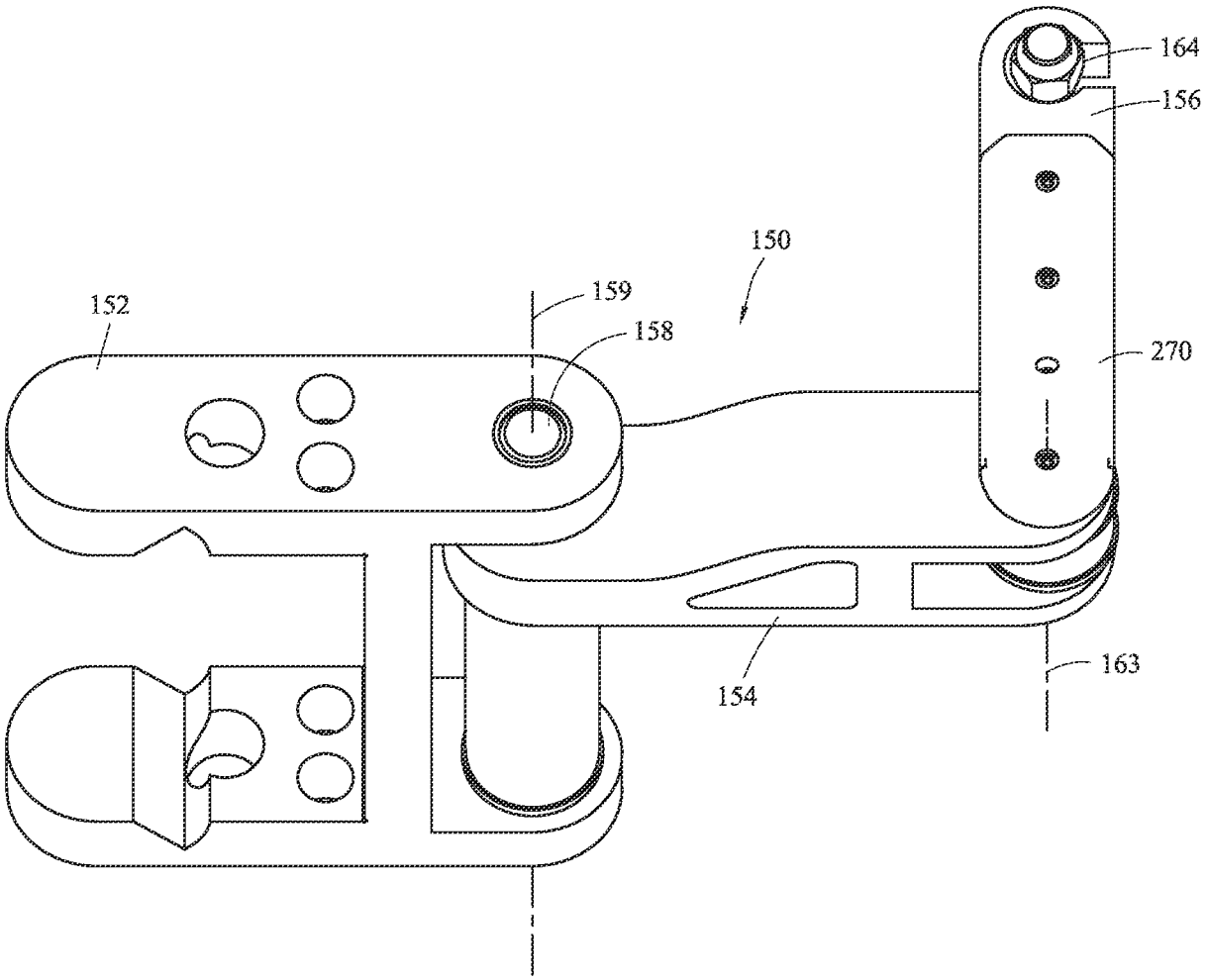
FIG. 5 is another perspective view of the ram changer assembly of FIG. 3 with the articulated arm in a first position.
Figure 7:
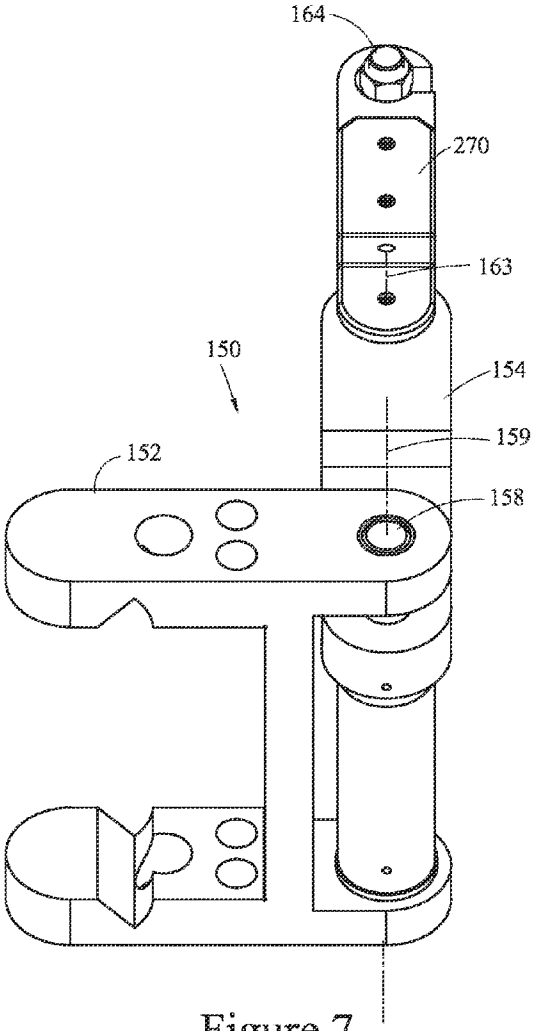
FIG. 7 is the ram changer assembly of FIGS. 3-6 with the articulated arm in a third position.
Figure 6:
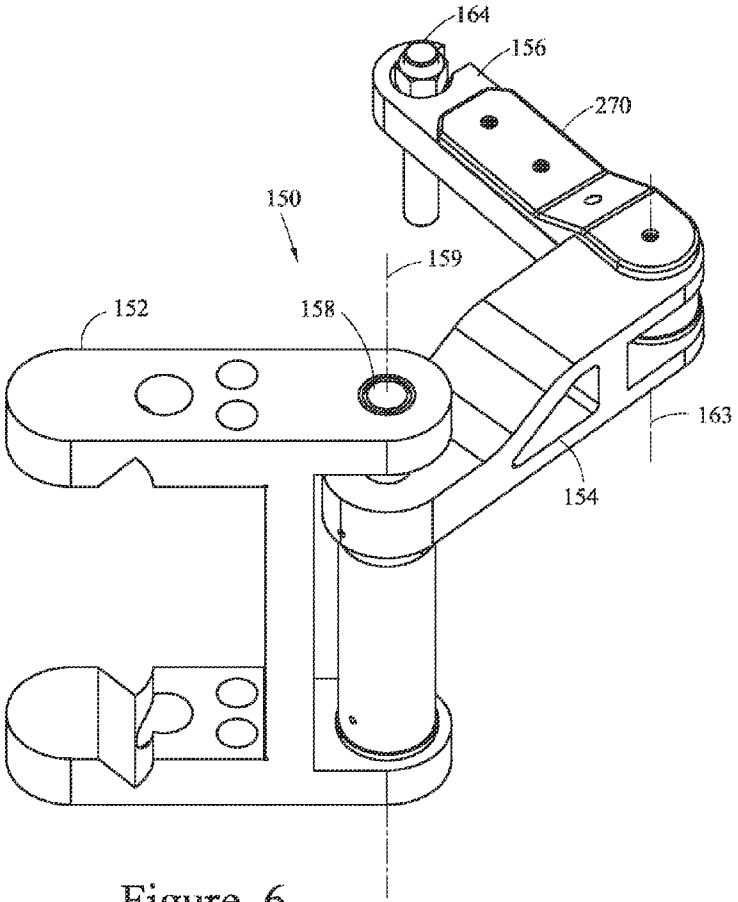
FIG. 6 is the ram changer assembly of FIGS. 3-5 with the articulated arm in a second position.
Figure 9:
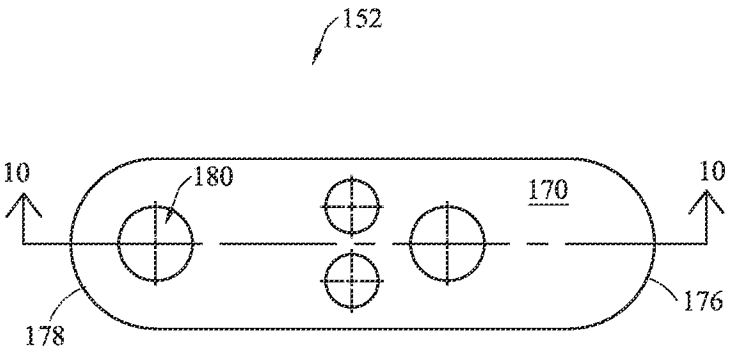
FIG. 9 is top view of the support bracket of FIG. 8.
Figure 8:
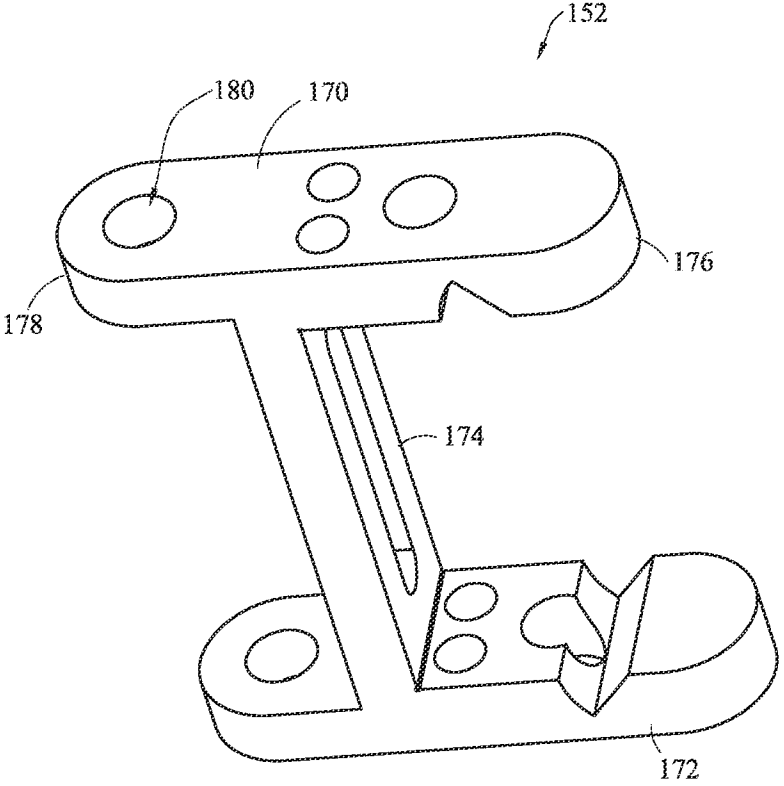
FIG. 8 is a perspective view of the support bracket of the ram changer assembly of FIGS. 3-7.
Figure 11:
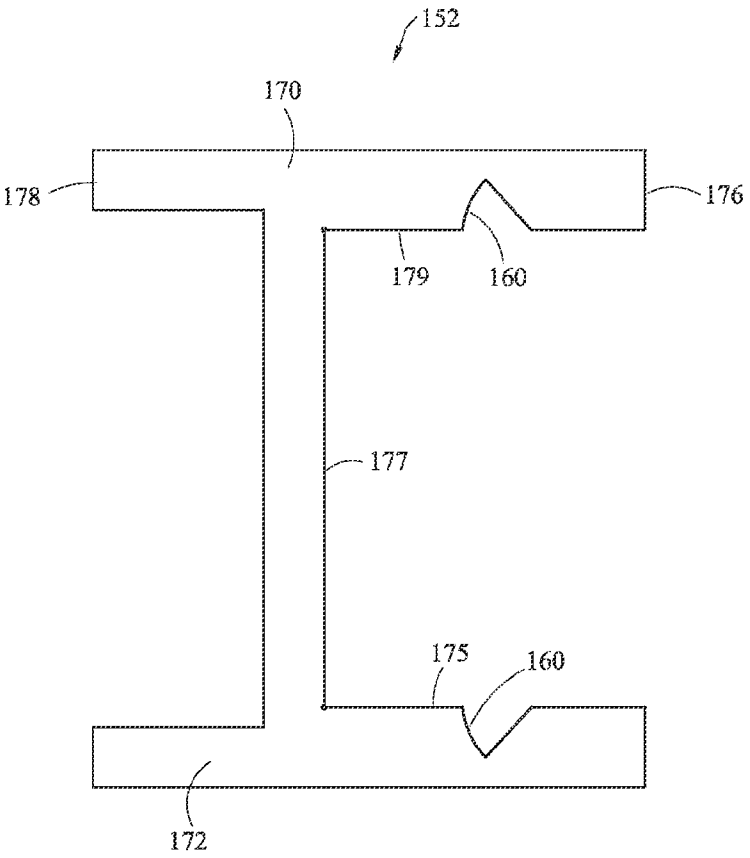
FIG. 11 is a side view of the support bracket of FIG. 9.
Figure 10:
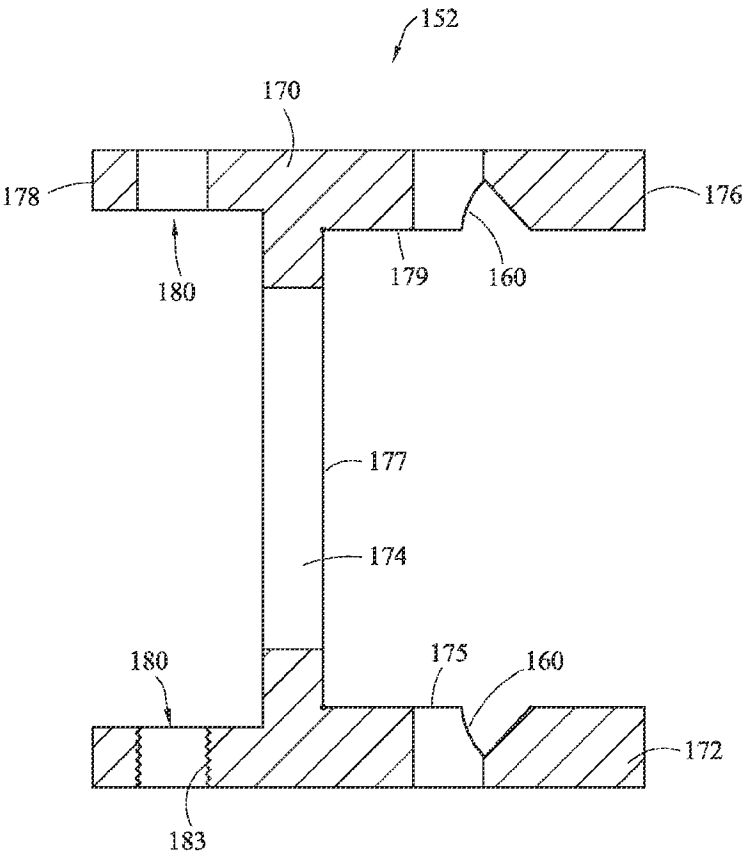
FIG. 10 is a cross-sectional view of the support bracket of FIG. 9.
Figure 13:
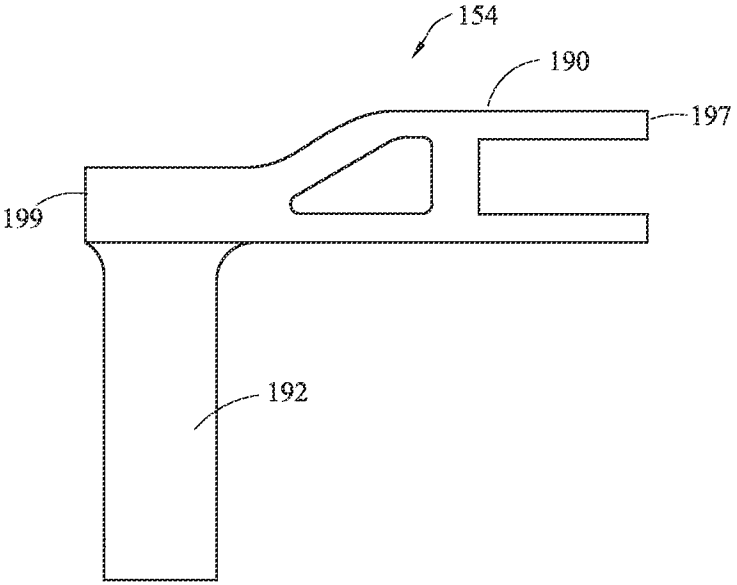
FIG. 13 is a side view of the L-shaped intermediate member of FIG. 12.
Figure 12:
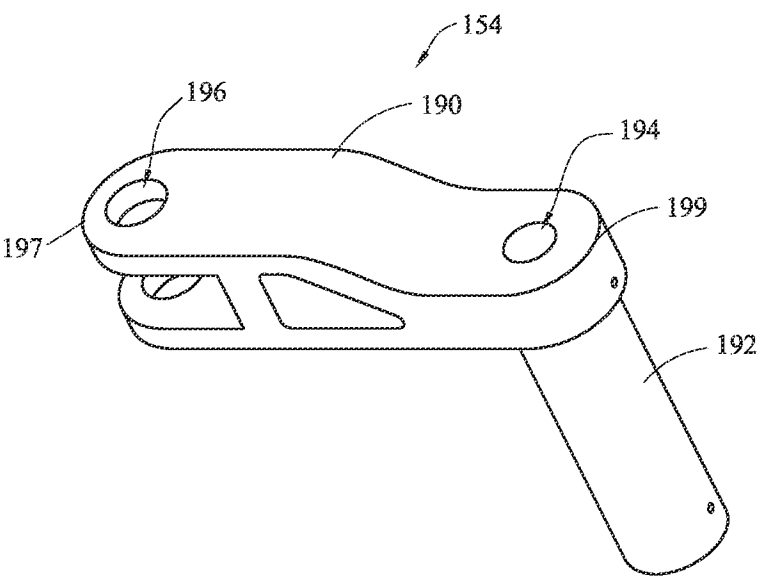
FIG. 12 is a perspective view of the L-shaped intermediate member of the ram changer assembly of FIGS. 3-7.
Figure 15:
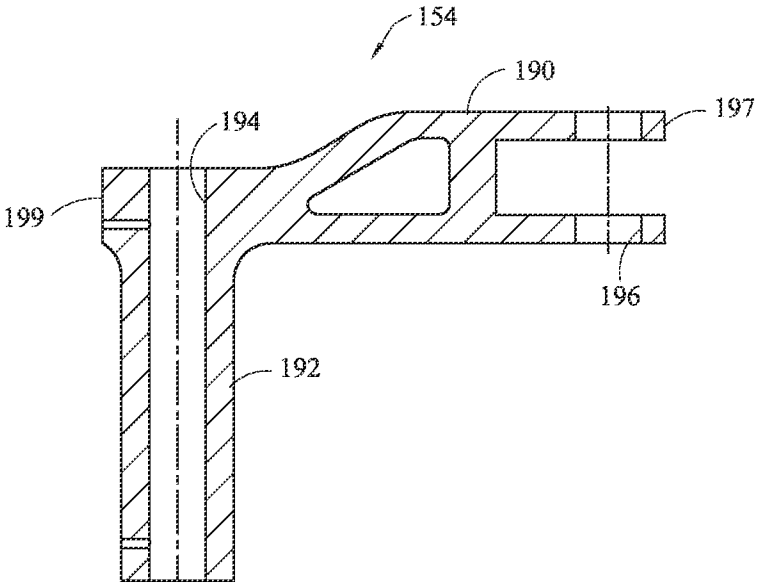
FIG. 15 is a cross-sectional view of the L-shaped intermediate member of FIG. 14.
Figure 14:
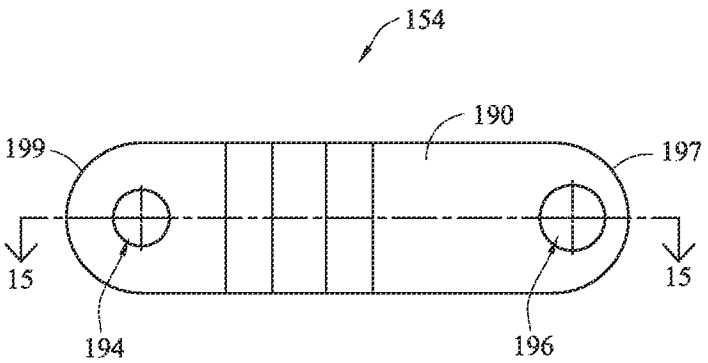
FIG. 14 is a top view of the L-shaped intermediate member of FIG. 12.

Referring now to FIGS. 5-7, exemplary movements of the articulated arm 155 are shown. The articulated arm 155 is a means pivotably coupling the ram block 117 to the support bracket 152 and thus the BOP 100. In FIG. 5, the ram coupling arm 156 is manipulated to pivot at pivot point 162 about the axis 163 from its position shown in FIG. 3. Turning to FIG. 6, the arm 155 can be further manipulated to pivot the L-shaped intermediate member 154 at pivot point 158 about the axis 159 from its position shown in FIG. 4. Further movements of the articulated arm 155 about the axes 159, 163 place the arm 155 in a further position as shown in FIG. 7. Though the articulated arm 155 is shown to rotate in a generally counterclockwise direction in FIGS. 3 and 5-7, the pivot points 158, 162 also allow a similar range of motion of the arm 155 in an opposite direction and past the starting position as shown in FIG. 3. Because of this symmetry of rotation of the articulating arm 155, the ram changer 150 can be used on either of the left-handed or right-handed doors 114 as shown in FIG. 2.

Referring to FIGS. 8-11, the support bracket 152 is shown in more detail. The support bracket 152 is a means for supporting the articulated arm 155 and thus the ram block 117. The bracket 152 includes a top portion 170 and a bottom portion 172 coupled by an intermediate member 174.

The bracket 152 includes an end 176 for coupling to the BOP door and an end 178 for coupling to the articulated arm 155. As shown in the top view of FIG. 9, the arm end 178 includes bores 180 for receiving the coupling pivot assembly 158. Further, the surface of the bottom portion 172 bounding the bore 180 includes a plurality of threads 183, best viewed in FIG. 10. As further shown in the cross-sectional side and side views of FIGS. 10 and 11, the door end 176 includes inner support surfaces 175, 177, 179 and grooves or slots 160. As will be shown in more detail below, the grooves 160 receive latches or other coupling members from the BOP door.

Turning now to FIGS. 12-15, the L-shaped intermediate member 154 of the ram changer 150 provides the base portion of the articulated arm 155. The L-shaped intermediate member 154 is a means for pivotably coupling the ram coupling member 156, and thus the ram block 117, to the support bracket 152 at the first axis of rotation 159. The L-shaped intermediate member 154 includes a body 190 and a coupling extension 192. A first end 197 includes bores 196 for receiving the coupling pivot assembly 162 connected to the ram coupling member 156. A second end 199 includes a bore 194 that extends through the coupling extension 192 for receiving the coupling pivot assembly 158 that extends through the bores 180 of the bracket 152.

Figure 17:
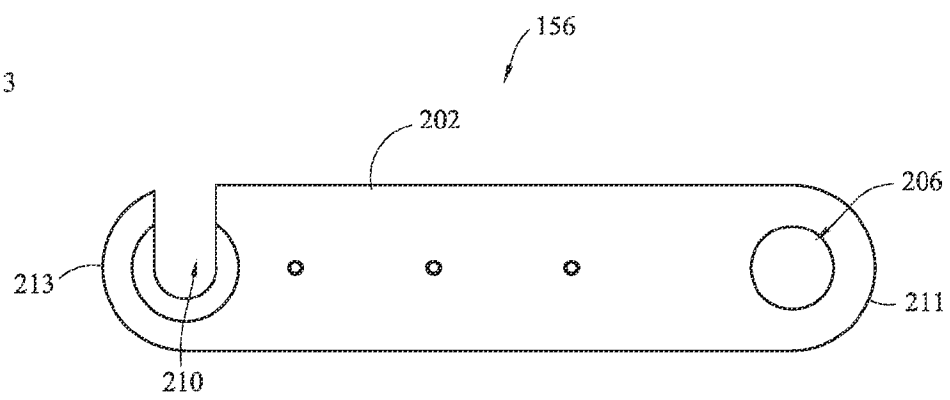
FIG. 17 is a top view of the ram coupling member of FIG. 16.
Figure 16:
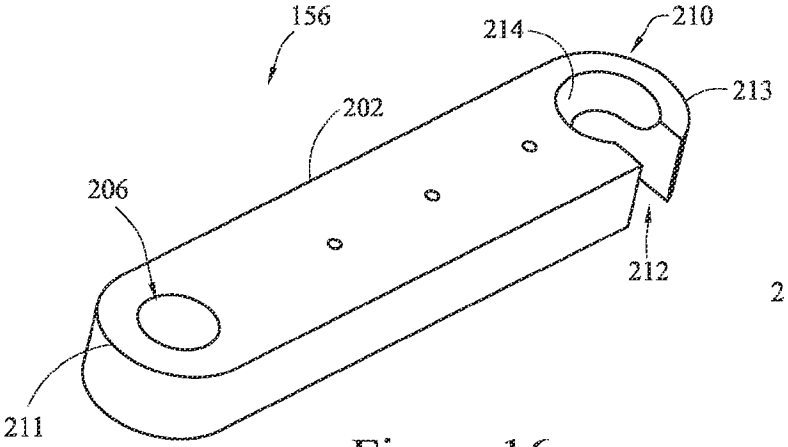
FIG. 16 is a perspective view of the ram coupling member of the ram changer assembly of FIGS. 3-7.
Figure 18:
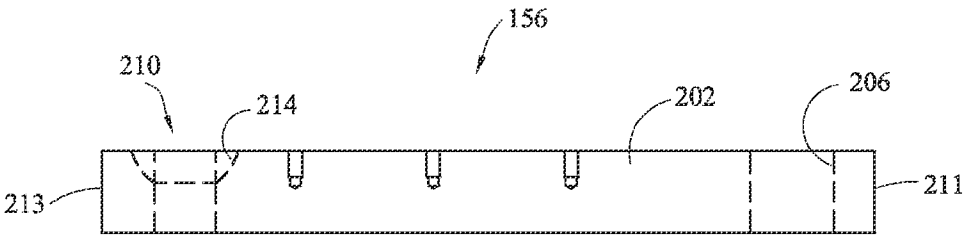
FIG. 18 is a cross-sectional side view of the ram coupling member of FIGS. 16-17.

Referring to FIGS. 16-18, the ram coupling member 156 of the ram changer 150 is shown in more detail. The ram coupling member 156 is a means for pivotably coupling the ram block 117 to the L-shaped intermediate member 154, and thus the support bracket 152, at the second axis of rotation 163. The ram coupling member 156 includes an elongate body 202 having a bore 206 extending through the ram coupling member 156 at a first end 211 and a bore 210 extending through the ram coupling member 156 at a second end 213. The bore 210 includes a slot 212 to make the bore 210 accessible from the exterior of the body 202, and a chamfer 214 to function as a support socket for receiving the bolt assembly 164. The bore 206 receives the coupling pivot assembly 162 that extends through the bores 196 of the L-shaped intermediate member 154. The body 202 further includes a plurality of threaded bores 217 each for receiving a screw 219 (FIG. 4), or other fastening device, to enable coupling of the stabilizer 270 to the ram coupling member 156.

Figure 20:
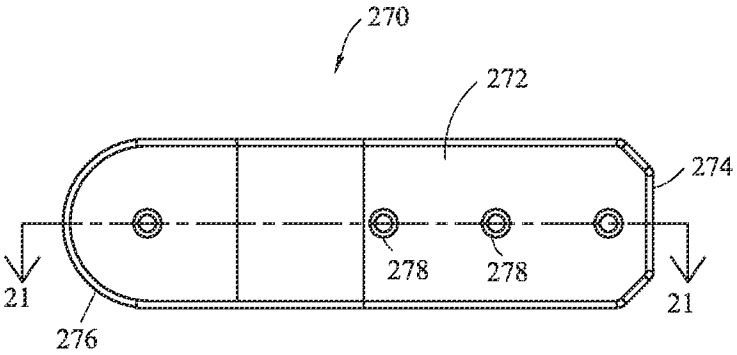
FIG. 20 is a top view of the stabilizer of FIG. 19.
Figure 19:
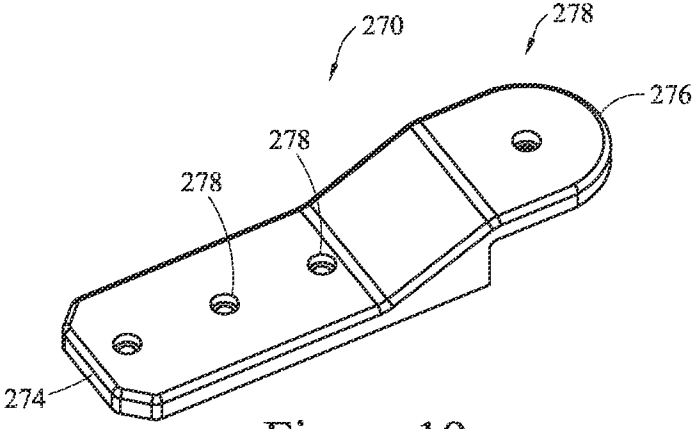
FIG. 19 is a perspective view of the stabilizer of the ram changer assembly of FIGS. 3-7.
Figure 21:
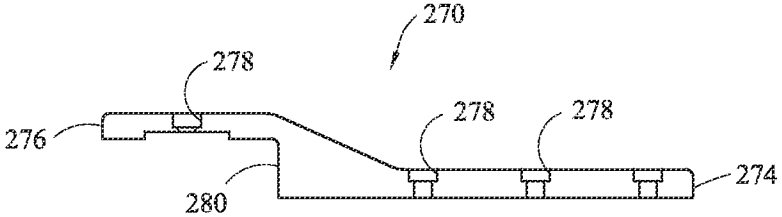
FIG. 21 is a cross-sectional, side view of the stabilizer of FIGS. 19-20.

Referring to FIGS. 19-21, the stabilizer 270 is shown in more detail. The stabilizer 270 includes an elongate body 272 having a first end 274, a second end 276, and plurality of bores 278 extending through the stabilizer 270 between ends 274, 276. Each of the bores 278 receives a screw 219 to enable coupling of the stabilizer 270 to the pivot coupling member 162 and the ram coupling member 156, as previously described. Proximate the second end 276, the stabilizer 270 further includes a shoulder 280 that receives the first end 197 of the L-shaped intermediate member 154 when the stabilizer 270 is coupled to the pivot coupling member 162 and the ram coupling member 156, as shown in FIG. 4. When coupled to the L-shaped intermediate member 154 through the pivot coupling member 162 and to the ram coupling member 156, the stabilizer 270 limits movement and/or deflection, or bending, of the ram coupling member 156 relative to the L-shaped intermediate member 154 that may be caused by loads applied to the ram coupling member 156, for example, by the bolt assembly 164 and other components connected thereto.

Referring still to FIG. 4, pivot coupling assembly 162, in this exemplary embodiment, includes a shaft 282 and two bearing members 284, 286. The shaft 282 has an upper end 288 and a lower end 290. The upper end 288 has a threaded bore 292 that receives a screw 219 to enable coupling of the stabilizer 270 to the pivot coupling assembly 162, as previously described. The upper bearing member 284 has a throughbore that receives the upper end 288 of the shaft 282. Similarly, the lower bearing member 286 has a throughbore that receives the lower end 290 of the shaft 282. When the pivot coupling assembly 162 is coupled between the L-shaped intermediate member 154, the ram coupling member 156, and the stabilizer 270, as shown, the bearing members 284, 286 limit movement of the ram coupling member 156 relative to the L-shaped intermediate member 154.

In this exemplary embodiment, the pivot coupling assembly 158 includes a shaft 300 that extends through the bore 194 of the L-shaped intermediate member 154, two bearing members 302, 304, and a control nut 306. The shaft 300 is rotatable within the bore 194 relative to the L-shaped intermediate member 154. Further, the shaft 300 has an upper end 308 and a lower end 310. The upper bearing member 302 has a throughbore that receives the upper end 308 of the shaft 300. Similarly, the lower bearing member 304 has a throughbore that receives the lower end 310 of the shaft 300. When the pivot coupling assembly 158 is coupled to the support bracket 152, as shown, the bearing members 302, 304 limit movement of the shaft 300 and the L-shaped intermediate member 154 disposed thereabout relative to the support bracket 152.

Figure 23:
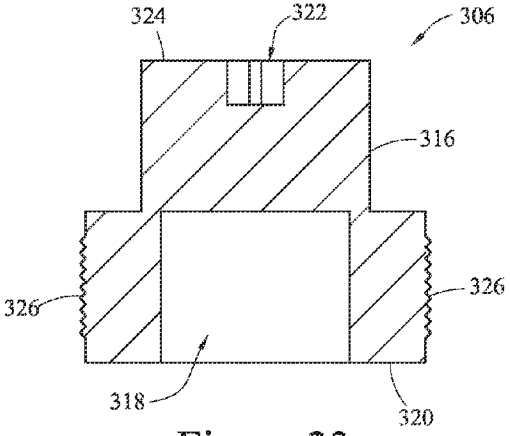
FIG. 23 is a cross-sectional, side view of the control nut of FIG. 22.
Figure 22:
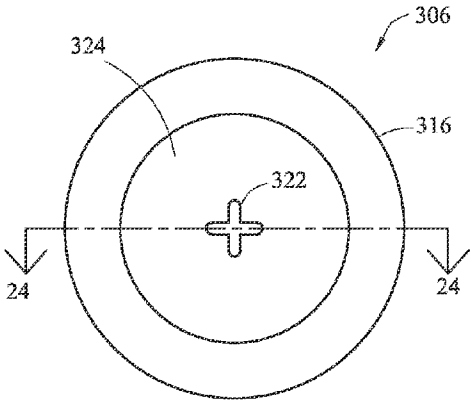
FIG. 22 is a bottom view of the control nut of the ram changer assembly of FIGS. 3-7.

Referring to FIGS. 22 and 23, the control nut 306 has a body 316 with a bore 318 at a first end 320 and a receptacle 322 at a second end 324. In some embodiments, the receptacle 322 is shaped to receive an end of a screwdriver. The control nut 306 further includes a plurality of threads 326 disposed about its outer surface and adapted to engage the threads 183 (FIG. 10) bounding the bore 180 in the bottom portion 172 of the support bracket 152. Thus, the control nut 306 is configured to threadably engage the support bracket 152, as illustrated by FIG. 4. When so engaged, the bore 318 of the control nut 306 receives the lower bearing member 304 and the lower end 310 of the shaft 300. Further, the position of the L-shaped intermediate member 154 relative to the support bracket 152 may be adjusted by insertion of an end of a screwdriver, or other device, into the receptacle 322 and rotation of the control nut 306 relative to the support bracket 152. Rotation of the control nut 306 causes the control nut 306, the lower bearing member 304, the shaft 300, and the L-shaped intermediate member 154 to move in a direction substantially parallel to axis 159 and either upward or downward relative to the support bracket 152, depending on the direction of rotation.

Figure 25:
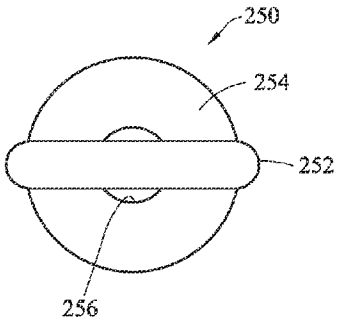
FIG. 25 is a top view of the lifting eye of FIG. 24.
Figure 24:
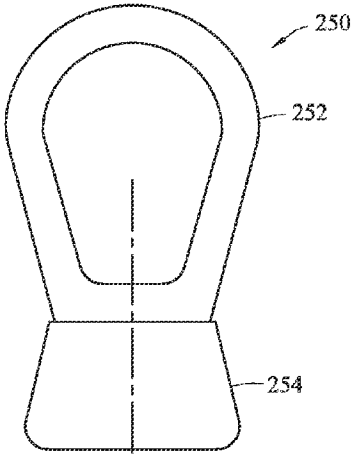
FIG. 24 is a side view of a lifting eye for the ram changer assembly of FIGS. 3-7.
Figure 29:
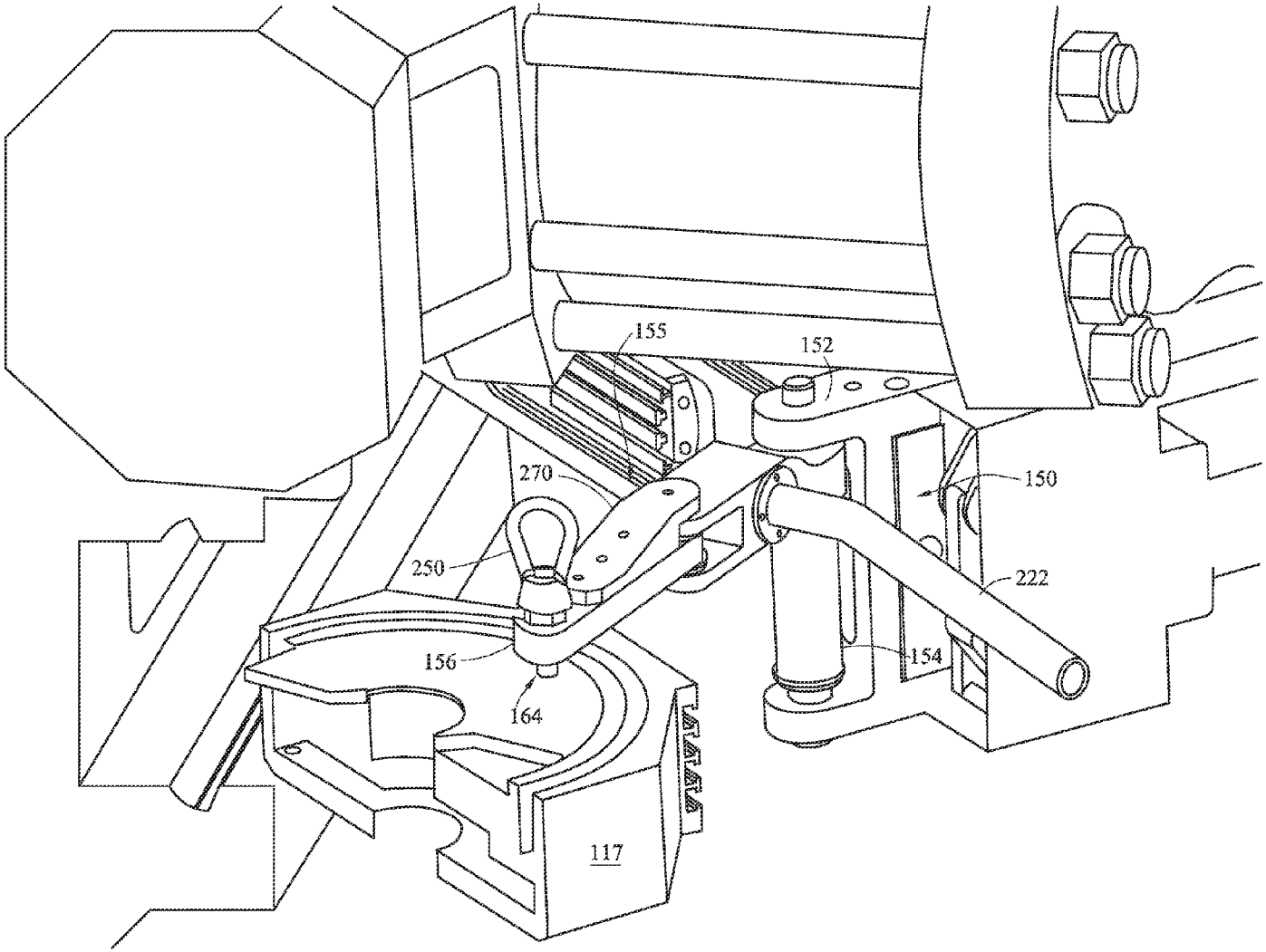

Referring now to FIGS. 24 and 25, a lifting eye 250 is shown. The lifting eye 250 may be coupled to the bolt assembly 164 and used to lift the ram block 117. The lifting eye 250 includes an upper eye portion 252 and a lower connector 254. The lower connector 254 includes a throughbore 256 that receives the bolt assembly 164, as shown in FIG. 29. The upper eye portion 252 enables coupling of a lifting mechanism thereto.

Figure 26:
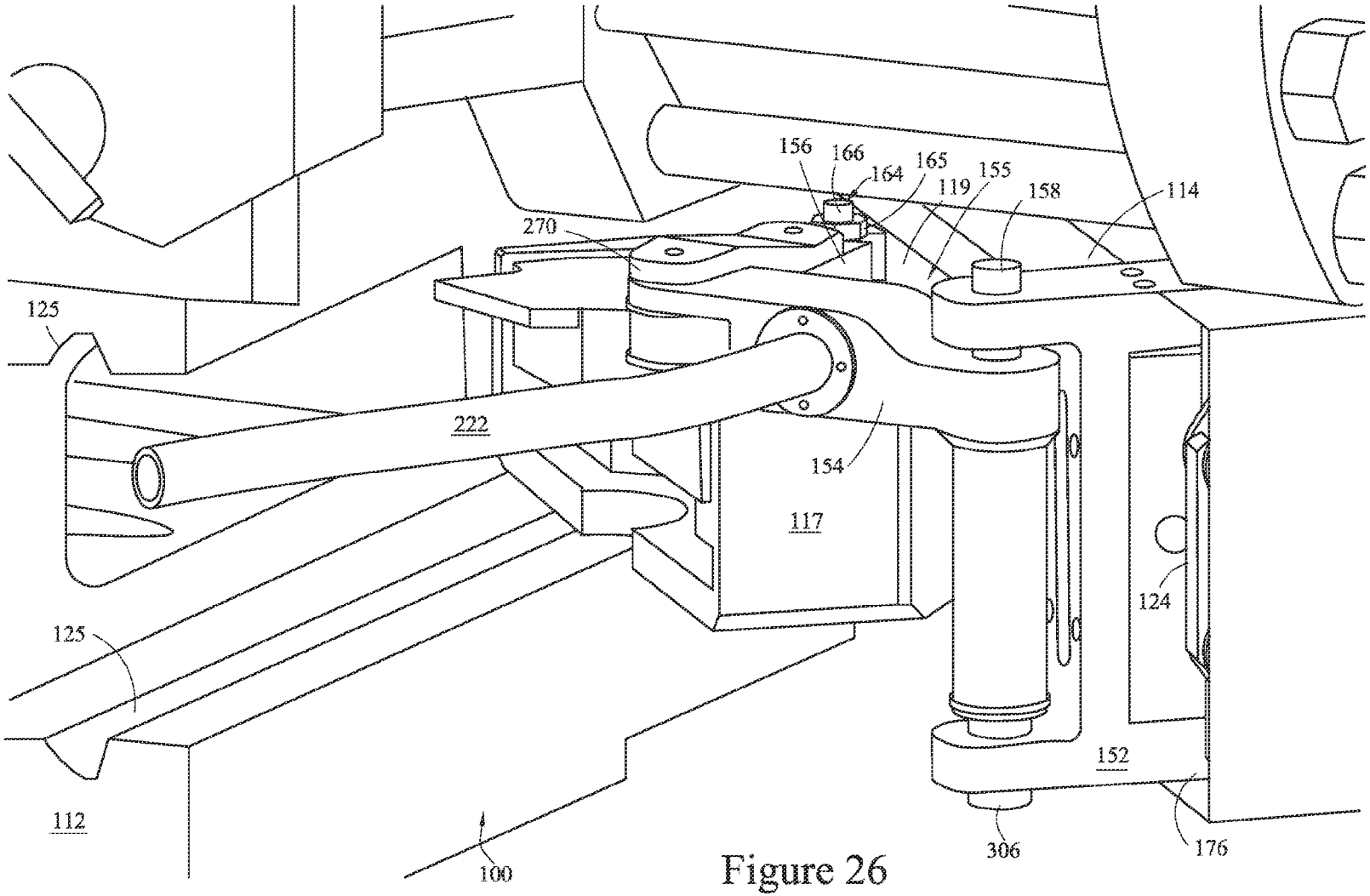
FIGS. 26-30 show various movements and positions of the ram changer assembly during operation.
Figure 30:
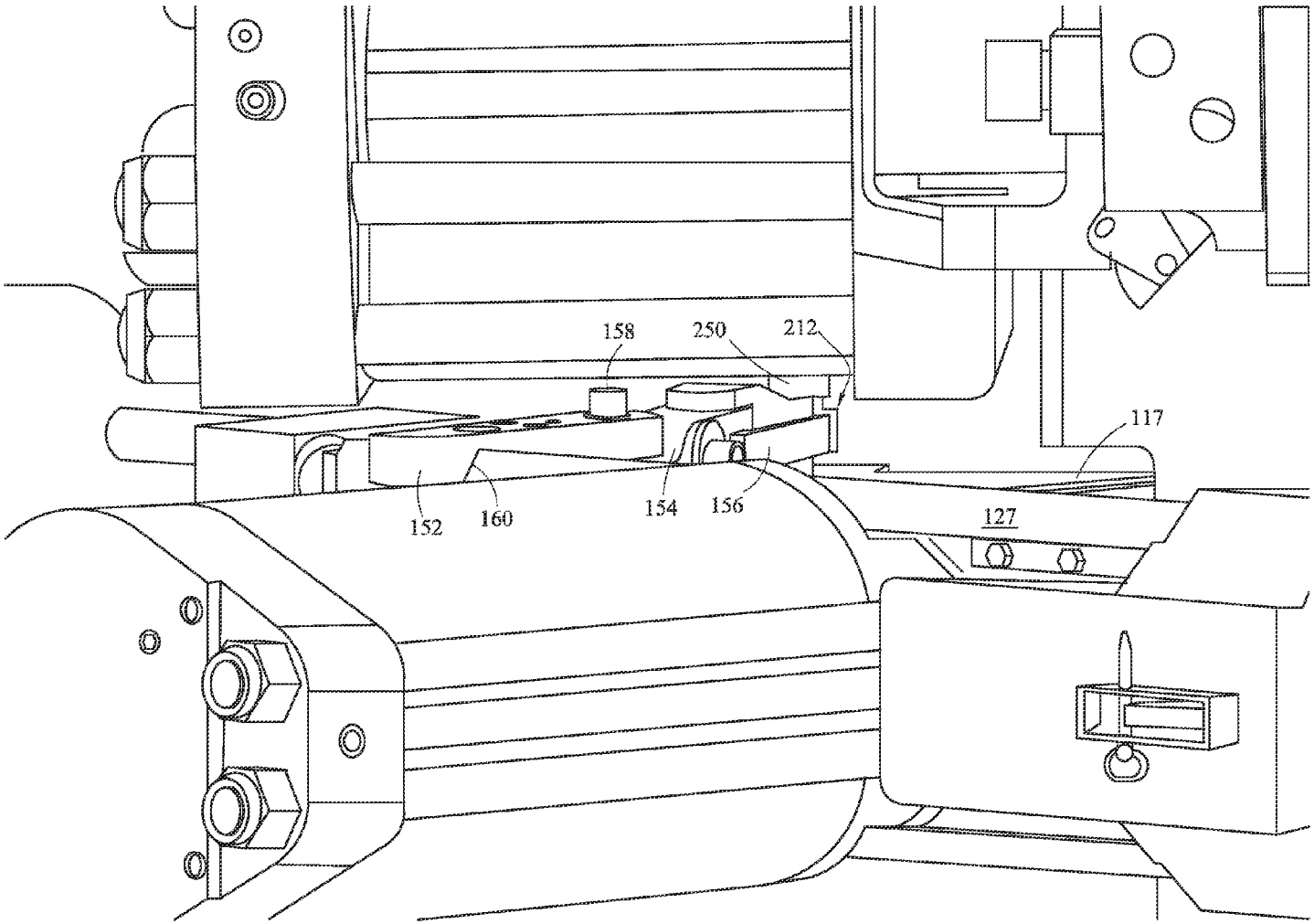

In operation, and referring first to FIG. 26, the door 114 is unlatched and opened for access to the ram block 117. The connector 124 includes upper and lower rotating latch members 127 (best shown in FIG. 30) that engage upper and lower grooves 125 to lock the door 114 in place. The connector 124 is actuated and the latch members 127 are rotated to remove the latch members 127 from the grooves 125 and unlatch the door 114. The ram changer 150 is coupled to the door 114 by placing the door end 176 of the support bracket 152 over the door 114 as shown. The support surfaces 175, 177, 179 (see FIGS. 10 and 11) now engage the door 114. There is clearance between the door 114 and the surfaces 175, 179 because the latch members 127 are retracted. To lock the bracket 152 into place, the connector 124 is again actuated to extend the latch members 127 into the grooves 160, as shown in FIG. 30. The grooves 160 have similar shapes to the BOP grooves 125 so as to replicate the door latching action of the latch members 127 with the bracket latching action for the ram changer 150. Because opposing latch members 127 engage opposing grooves 160, the latching action of the latch members 127 also serves to center the bracket 152 about the door 114 and to pull the bracket surfaces 175, 177, 179 into contact with the door 114. Though one embodiment of the ram changer latching or coupling mechanism has been described, other exemplary embodiments include moveable latch members mounted on the bracket 152 or bolts used to secure the bracket 152 onto the door 114.

Still referring to FIG. 26, the ram block 117 is releasably coupled to the end of the ram shaft at an interface 119. In some embodiments, the interface 119 includes mating T-slot and T-bar surfaces on each of the ram block 117 and the ram shaft for coupling and de-coupling by lateral movement of the ram block 117. Alternative embodiments include other similar slidable or releasable coupling interfaces. The articulated arm 155 is manipulated to the position shown in FIG. 27. In some embodiments, the articulated arm 155 is moved by one or more operators. The bolt assembly 164, having a nut 165 threadably disposed about a bolt 166, is coupled to the ram block 117 and the nut 165 is adjusted relative the bolt 166 to ensure proper seating of the bolt assembly 164 in the socket 214 of the ram coupling member 156.

Figure 27:
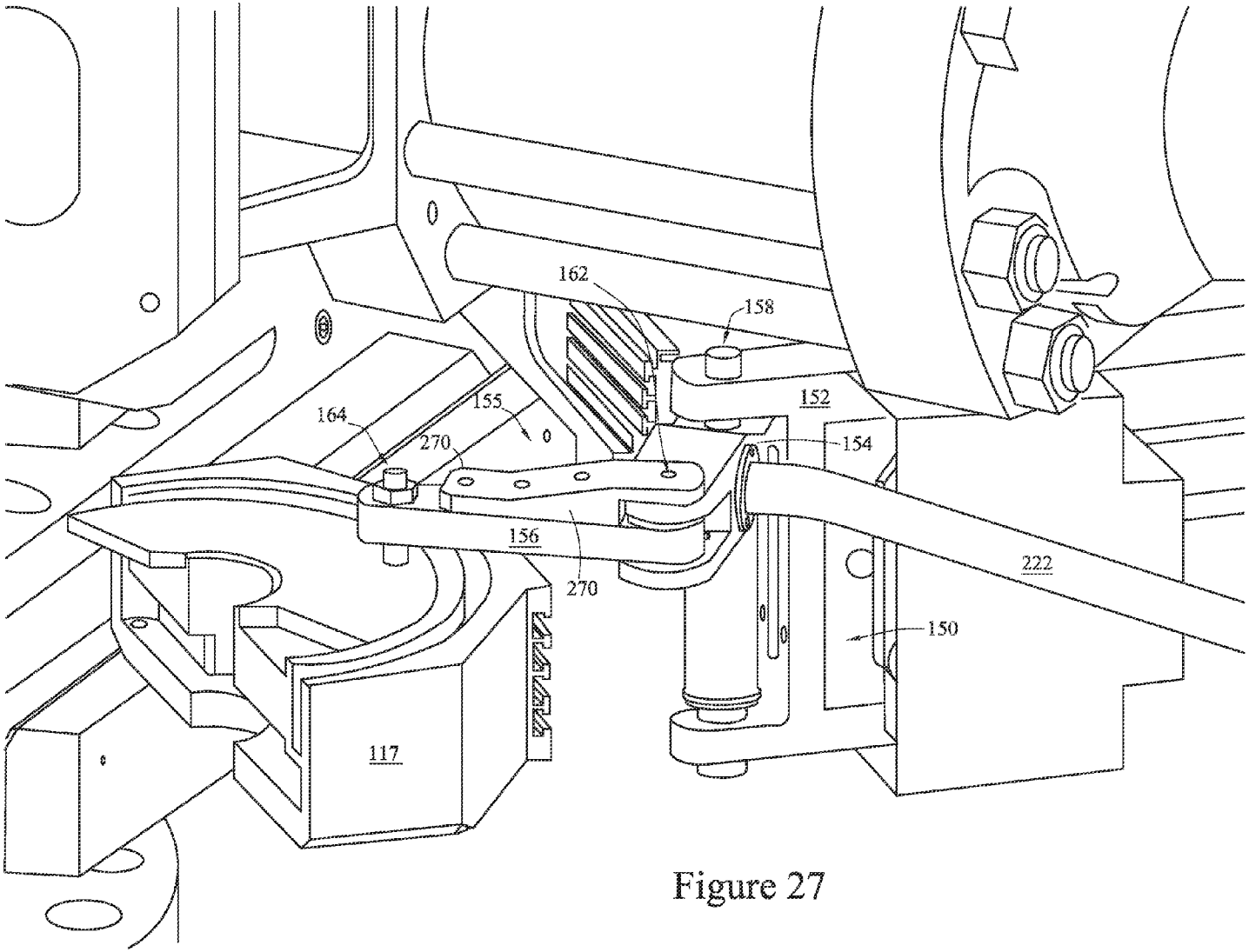

Referring to FIG. 27, the ram block 117 is moved laterally to de-couple and release it at the ram shaft interface 119. In some embodiments, the ram block 117 is moved by inserting a rod 222 member into a passage 215 (FIG. 4) in the L-shaped intermediate member 154. The rod 222 can then be used as a lever to force the articulated arm 155 toward the support bracket 152, via rotation of the L-shaped intermediate member 154 about the pivot point 158 and rotation of the ram coupling member 156 about the pivot point 162. Consequently, the ram block 117 will slide along the T-rails on the ram shaft. In alternative embodiments, the ram block 117 is moved by other means, such as a spring-loaded mechanism or a worm gear coupled to the L-shaped intermediate member 154. In still further embodiments, a force is applied to the ram block 117 itself to move the ram block 117 while the engaged ram changer 150 supports the weight of the ram block 117.

Figure 28:
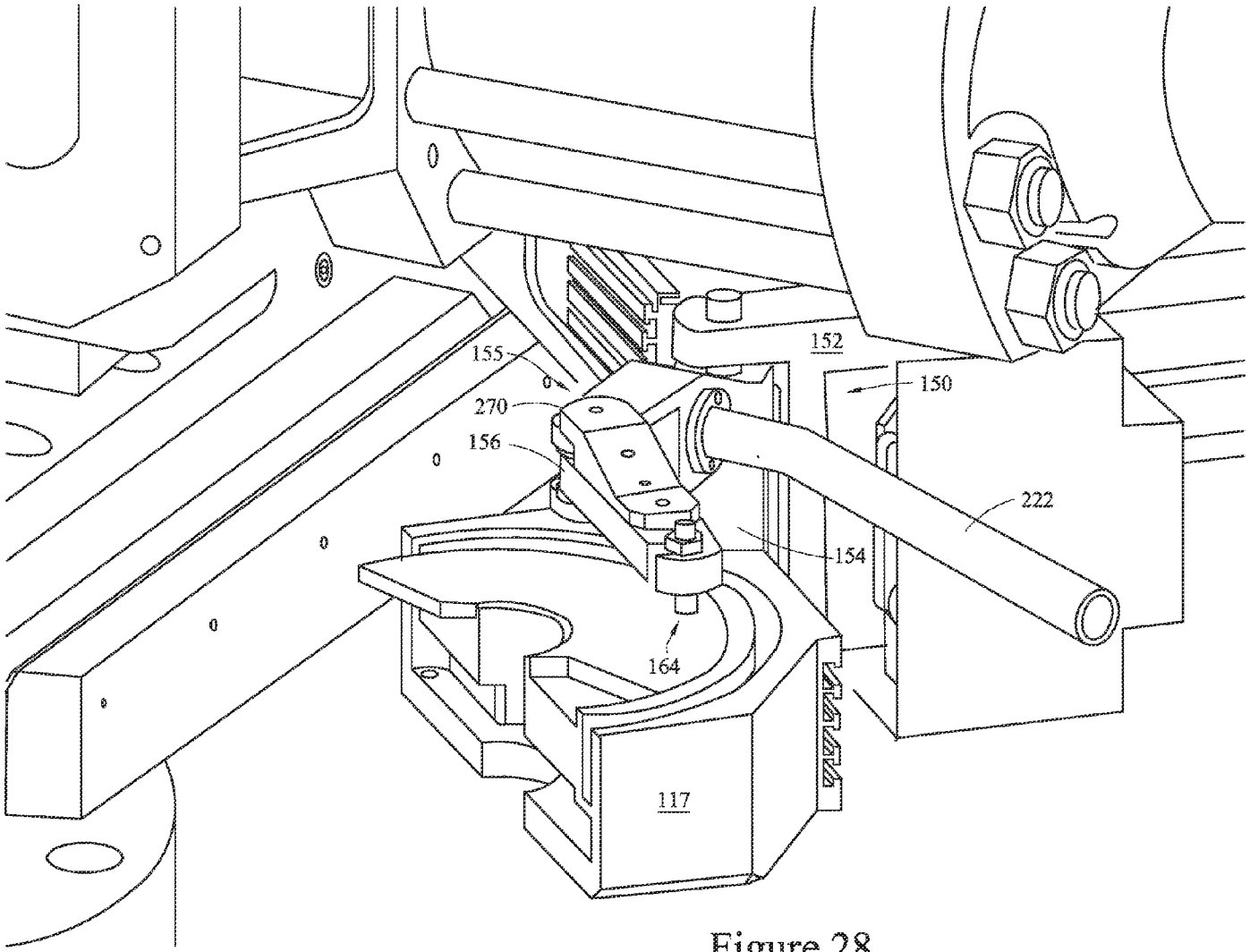

Referring to FIG. 28, the ram block 117 is released from the T-rail arrangement on the ram shaft and moved to a spaced-apart location from same. Because the pivoting of articulated arm 155 includes multiple axes of rotation, the ram changer 150 is able to accommodate both the linear motion of the ram block 117 during disengagement with the T-rails as well as the spacing motion of the ram block 117 in another direction. During these movements, the ram changer 150 supports the weight of the ram block 117 in a confined space adjacent the BOP 100 and the open door 114. Turning to FIG. 29, the lifting eye 250 may now be attached to the bolt assembly 164, and a lifting mechanism may be coupled to the lifting eye 250 for further lifting and removal of the ram block 117. The slot 212, best viewed in FIG. 30, in the ram coupling member 156 facilitates removal of the ram block 117 by providing an exit path for the bolt assembly 164.

Referring still to FIG. 29, the articulated arm 155 is able to locate the ram block 117 for removal by a lifting mechanism, or to receive a ram block 117 for installation. For installation, the articulated arm 155 receives the ram block 117 with the bolt assembly 164 and lifting eye 250 in a manner similar to that previously described. The ram block 117 and the articulated arm 155 are then moved in the manners described, except in opposite directions until the ram block 117 is securely fastened at the ram shaft interface 119.

The ram block changer or mover 150 includes an articulating arm mechanism to engage the ram block and move it. The motion of the articulating arm includes a linear motion and a rotational motion. Consequently, the ram block moves into and out of the cavity connection with little friction during installation or removal for maintenance. In some embodiments, one operator can remove and replace the ram block with efficiency and little risk of personal injury. Because the support bracket 152 is removeable from the BOP door, the ram changer 150 is portable.

The embodiments set forth herein are merely illustrative and do not limit the scope of the disclosure or the details therein. It will be appreciated that many other modifications and improvements to the disclosure herein may be made without departing from the scope of the disclosure or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. An apparatus for engaging and moving a ram block, the apparatus comprising:

a support bracket configured to releasably couple to a blowout preventer assembly; and an articulated arm coupled to the support bracket and configured to releasably couple to a removeable ram block, wherein the articulated arm comprises first and second axes of rotation;

wherein the articulated arm is configured to remove the ram block from an interior of the blowout preventer assembly in response to rotating the ram block relative to the blowout preventer assembly about both the first axis of rotation and the second axis of rotation in the same rotational direction.

2. The apparatus of claim 1, wherein the articulated arm is simultaneously rotatable about the first and second axes of rotation.

3. The apparatus of claim 1, wherein the articulated arm comprises a throughbore for receiving an elongated member that is releasably coupled to the ram block.

4. The apparatus of claim 1, further comprising a first pivot coupling assembly disposed coaxially with the first axis of rotation and coupling the support bracket to the articulated arm, wherein the articulated arm is rotatable about the first axis of rotation relative to the support bracket.

5. The apparatus of claim 4, wherein the first pivot coupling assembly comprises:

a shaft extending through the support bracket and the first member;

a bearing member disposed between each end of the shaft and the support bracket, the bearing members limiting movement of the shaft relative to the support bracket.

6. The apparatus of claim 4, wherein the first pivot coupling assembly comprises:

a shaft extending through the support bracket and the first member; and a control nut disposed between an end of the shaft and the support bracket; the control nut rotatably engaged with the support bracket, wherein the shaft is moveable relative to the support bracket with rotation of the control nut.

7. The apparatus of claim 6, wherein the shaft is moveable in a direction parallel to the axial centerline of the shaft.

8. The apparatus of claim 4, wherein the articulated arm comprises:

a first member receiving the first pivot coupling assembly therethrough;

a second member coupled to the removable ram block; and a second pivot coupling assembly disposed coaxially with the second axis of rotation and spaced apart from the first pivot coupling assembly and extending through the first and second members;

wherein the second member is rotatable about the second axis of rotation relative to the first member.

9. The apparatus of claim 4, wherein the articulated arm comprises:

a first member receiving the first pivot coupling assembly therethrough;

a second member coupled to the removable ram block; and a stabilizer coupled between the first member and the second member, the stabilizer limiting deflection of the first member relative to the second member.

10. The apparatus of claim 1, wherein the articulated arm is configured to remove the ram block from a ram shaft of the blowout preventer assembly by rotating the ram block relative to the blowout preventer about both the first axis of rotation and the second axis of rotation in the same rotational direction.

11. An apparatus for engaging and moving a ram block, the apparatus comprising:

a support portion disposed adjacent a blowout preventer assembly; and an articulated arm comprising a first member pivotally coupled to the support portion at a first joint having a first axis of rotation, and a second member pivotally coupled to the first member at a second joint having a second axis of rotation, the second member configured to couple to and support the ram block;

wherein the articulated arm is configured to remove the ram block from an interior of the blowout preventer assembly in response to rotating the ram block concurrently about the first axis of rotation and the second axis of rotation in the same rotational direction.

12. The apparatus of claim 11, wherein the first member is slideable along the first axis of rotation at the first joint.

13. The apparatus of claim 11, wherein the second member comprises a throughbore and a slot extending therefrom, the slot defining a passage from the throughbore.

14. The apparatus of claim 13, further comprising a bolt supported in the throughbore of the second member and coupled at one end to the ram block.

15. The apparatus of claim 11, wherein the articulated arm is simultaneously rotatable about the first and second axes of rotation.

16. The apparatus of claim 11, further comprising a nut coupled to the support portion, the nut rotatable relative to the support portion to move the first member about the first axis of rotation.

17. The apparatus of claim 11, further comprising a third member coupled between the first and second members, the third member resisting bending of the second member relative to the first member.

18. The apparatus of claim 11, wherein the ram block is moveable in a nonlinear motion relative to the blowout preventer assembly as at least one of the first member and the second member rotates about at least one of the axes of rotation.

19. The apparatus of claim 11, wherein the ram block is moveable in a linear motion relative to the blowout preventer assembly as at least one of the first member and the second member rotates about at least one of the axes of rotation.

20. The apparatus of claim 11, wherein the articulated arm is configured to remove the ram block from a ram shaft of the blowout preventer assembly by rotating the ram block concurrently about the first axis of rotation and the second axis of rotation in the same rotational direction.

21. A method for engaging and moving a ram block, the apparatus comprising:

coupling a support bracket and an articulated arm to a blowout preventer assembly;

coupling a removeable ram block to the articulated arm having a first axis of rotation and a second axis of rotation; and removing the ram block from an interior of the blowout preventer assembly by concurrently rotating the ram block about the first axis of rotation in a first direction and about the second axis of rotation in the first direction.

22. The method of claim 21, further comprising moving the ram block in a nonlinear motion relative to the blowout preventer assembly.

23. The method of claim 21, further comprising moving the ram block in a linear motion relative to the blowout preventer assembly.

24. The method of claim 21, wherein coupling the removeable ram block to the articulated arm comprises receiving an elongated member that is releasably coupled to the ram block into a throughbore of the articulated arm.

* * * * *